US010426987B2

(12) United States Patent
Pulz

(10) Patent No.: US 10,426,987 B2
(45) Date of Patent: Oct. 1, 2019

(54) FIREFIGHTING FOAM GENERATOR

(71) Applicant: Robert Pulz, Acacia Ridge (AU)

(72) Inventor: Robert Pulz, Acacia Ridge (AU)

( * ) Notice: Subject to any disclaimer, the term of this patent is extended or adjusted under 35 U.S.C. 154(b) by 86 days.

(21) Appl. No.: 14/959,785

(22) Filed: Dec. 4, 2015

(65) Prior Publication Data

US 2016/0158589 A1 Jun. 9, 2016

(30) Foreign Application Priority Data

Dec. 8, 2014 (AU) ..... 2014904954
Sep. 10, 2015 (AU) ..... 2015903682

(51) Int. Cl.

| | |
|---|---|
| ***A62D 1/00*** | (2006.01) |
| ***B01F 3/00*** | (2006.01) |
| ***A62D 1/02*** | (2006.01) |
| ***B01F 3/04*** | (2006.01) |
| ***B01F 5/04*** | (2006.01) |
| ***B01F 5/06*** | (2006.01) |

(52) U.S. Cl.

CPC ..... *A62D 1/0071* (2013.01); *B01F 3/04446* (2013.01); *B01F 5/0408* (2013.01); *B01F 5/0463* (2013.01); *B01F 5/0606* (2013.01)

(58) Field of Classification Search

CPC .... B05B 7/0018; B01F 5/0408; B01F 3/0446; B01F 5/0463; B01F 5/0606

See application file for complete search history.

(56) References Cited

U.S. PATENT DOCUMENTS

| | | | | | |
|---|---|---|---|---|---|
| 2,183,561 | A * | 12/1939 | Hamblin | A62C 5/024 | 138/37 |
| 3,709,302 | A * | 1/1973 | Stults | A62C 5/022 | 169/9 |
| 3,734,111 | A * | 5/1973 | McClintock | B01F 5/0451 | 137/3 |
| 5,382,389 | A * | 1/1995 | Goodine | B01F 5/0408 | 169/15 |
| 6,042,089 | A * | 3/2000 | Klein | B01F 5/0403 | 261/76 |
| 7,784,709 | B1 * | 8/2010 | Williams | A62C 31/07 | 239/11 |

* cited by examiner

*Primary Examiner* — Anshu Bhatia
(74) *Attorney, Agent, or Firm* — Dinsmore & Shohl LLP

(57) ABSTRACT

Embodiments described herein relate to firefighting foam generators. The generators may include a receptacle for receiving liquid. A gas supply may be provided for supplying gas into the liquid to create foam. At least one turbulence creator may be provided for creating turbulence in the receptacle. Advantageously, the firefighting foam generators create turbulence to assist with mixing the gas and liquid when creating the foam. The embodiments provide for improved mixing and evenness of foam, without foam flooding, when compared with known foam generators. The embodiments are also simple to manufacture when compared with known foam generators.

17 Claims, 3 Drawing Sheets

FIREFIGHTING FOAM GENERATOR

CROSS REFERENCE TO RELATED APPLICATIONS

The present specification claims priority to Australian Patent Application No. 2014904954 filed on Dec. 8, 2014 and Australian Patent Application No. 2015903682 filed on Sep. 10, 2015, each of which is incorporated by reference herein in their entirety.

TECHNICAL FIELD

The present specification relates to a firefighting foam generator.

BACKGROUND

The reference to any prior art in this specification is not, and should not be taken as an acknowledgement or any form of suggestion that the prior art forms part of the common general knowledge.

Traditionally, firefighters pumped pressurized water to extinguish fires.

In recent times, compressed air foam system (CAFS) generators have been used to generate foam to extinguish fires. Advantageously, the foam extinguishes more fire than water per unit volume, and therefore results in more infrequent filling of firefighting storage tanks.

A known foam generator includes a receptacle for receiving flowing water, and an air supply for supplying pressurized air into the water. The air supply includes a pair of plates extending across the receptacle. An upstream plate defines water inlets, and a downstream plate defines water outlets and air outlets. Water conduits extend between corresponding water inlets and outlets in respective plates, and transport water in a laminar manner between the plates. The air supply provides pressurized air between the plates. The pressurized air exits through the air outlets and is introduced into the laminar water exiting the plates to create foam. The known foam generator is complex to manufacture requiring advanced machining of parts.

The embodiments described herein provide an improved firefighting foam generator.

SUMMARY

According to one aspect of the specification, there is provided a firefighting foam generator that may include:

- a receptacle for receiving a flow of liquid;
- a gas supply for supplying pressurized gas into the flow of liquid to create foam, the gas supply comprising a tube which extends into the receptacle transverse to the flow of liquid, the tube includes a plurality of gas outlets; and
- a first and a second turbulence creator, each for creating turbulence in the receptacle,
  - the first turbulence creator including a baffle positioned within the receptacle at a first location spaced apart from and upstream of the tube, relative to the flow of liquid, and
  - the second turbulence creator including a baffle positioned within the receptacle at a second location downstream of the tube, relative to the flow of liquid,
  - each turbulence creator comprising an edge, positioned transverse to the flow of liquid, which extends between and contacts the receptacle at a first position and a second position.

Advantageously, the firefighting foam generator creates turbulence to assist with mixing the gas and liquid when creating the foam. In embodiments, the firefighting foam generator provides for improved mixing and evenness of foam, without foam flooding, when compared with known foam generators. The firefighting foam generator of these embodiments is also simple to manufacture when compared with known foam generators.

The liquid used in conjunction with the firefighting foam generator may include surfactant and water. The receptacle may receive flowing liquid. The liquid may include water. The gas may include air. The gas may be pressurized.

The at least one turbulence creator may be located upstream or downstream of a region where gas is introduced into the liquid. In one embodiment, the at least one turbulence creator may include both an upstream turbulence creator located upstream of a region where gas is introduced into the liquid, and a downstream turbulence creator located downstream of a region where gas is introduced into the liquid.

The turbulence creator may include an impermeable portion of a tube that impacts with the liquid and is located upstream from gas outlets. Alternatively or additionally, the turbulence creator may include a baffle upstream of the gas supply.

The turbulence creator may include a diffuser for diffusing the gas in the liquid. The diffuser may be located downstream of the gas supply. The diffuser may include one or more baffles. The baffles may be alternating. Each baffle may occupy about half of the cross section of the receptacle. Each baffle may define teeth.

The gas supply may include a tube. The tube may extend transverse to the flow of the liquid. The tube may be arranged so that the liquid splits around either side of the tube. The tube may include gas outlets. The outlets may include rows of perforations. Each row of perforations may be staggered relative to any adjacent row. The outlets may be located entirely on a downstream half of the tube.

The tube may be releasable. The tube may include an orientation indicator to indicate the orientation of the tube in the receptacle. The orientation indicator may be located at an outside end of the tube. The orientation indicator may include one or more notches. The tube may define a head for resting on the receptacle when a tail extending from the head extends into the receptacle.

The generator may include a retainer for retaining the tube within the receptacle. The retainer may include a tubular guide extending from the receptacle. The guide may define a fastening hole which can align with a fastening hole of the tube. The retainer may further include a grub screw for passing through the holes to retain the tube within the receptacle.

The receptacle may be elongate. The receptacle may taper at one or both ends. In one embodiment, the receptacle may include a pipe terminated by a pair of conical reducers. Each end of the receptacle may be threaded to facilitate connection to threaded fasteners.

According to another aspect of the fire fighting foam generator, there is provided a method for generating firefighting foam, the method including:

- introducing a gas in a liquid and creating turbulence to produce foam.

Any of the features described herein can be combined in any combination with any one or more of the other features described herein within the scope of the specification.

BRIEF DESCRIPTION OF THE DRAWINGS

Features, embodiments and variations of the firefighting foam generators, and methods for using the same, may be discerned from the following Detailed Description which provides sufficient information for those skilled in the art to perform the firefighting foam generators and methods for using the same. The Detailed Description is not to be regarded as limiting the scope of the preceding Summary in any way. The Detailed Description will make reference to a number of drawing as follows.

DETAILED DESCRIPTION

Figure 1:
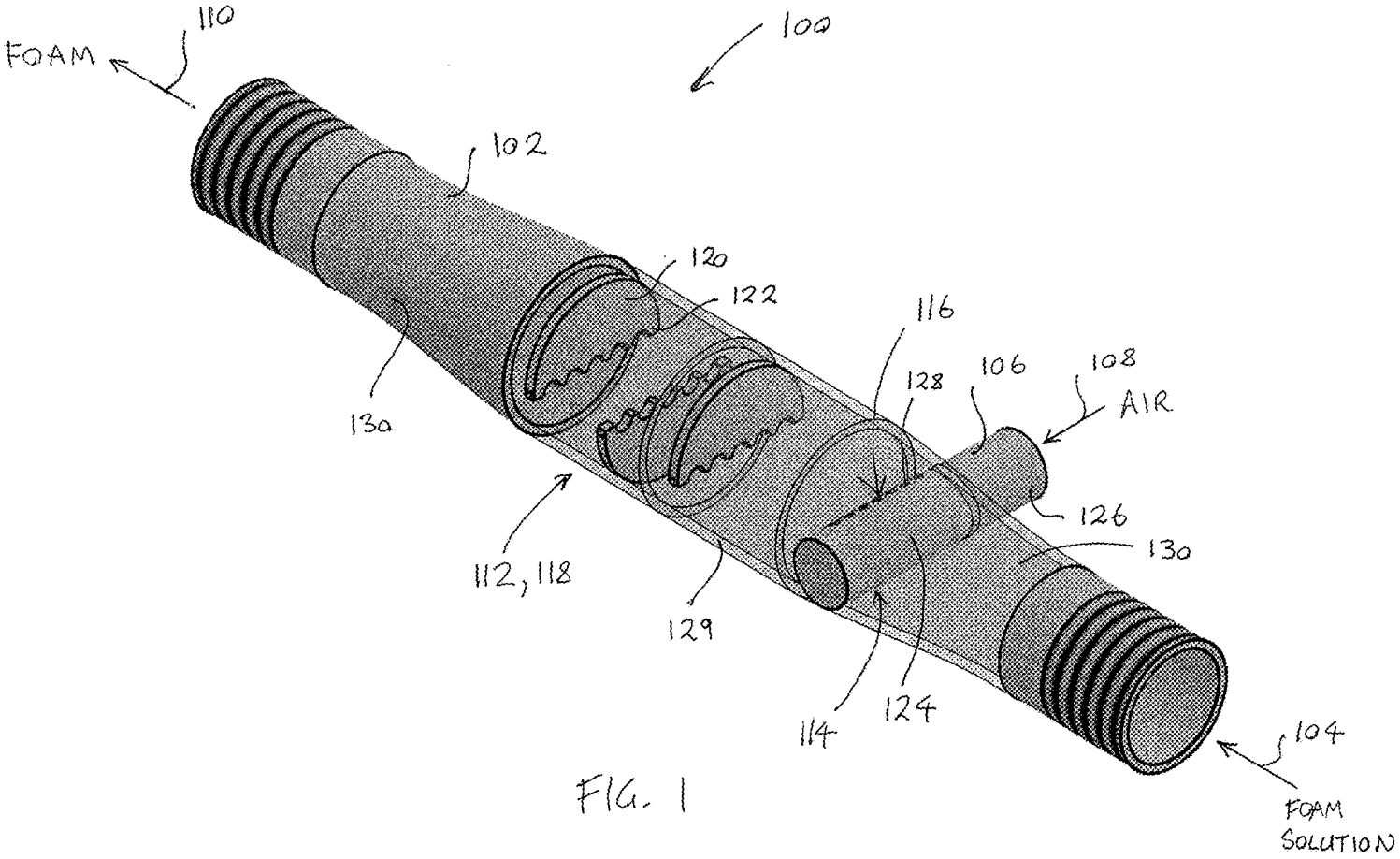
FIG. 1 is a perspective view of a firefighting foam generator in accordance with an embodiment of the firefighting foam generator.

According to an embodiment, there is provided a firefighting foam generator 100 for a CAFS as shown in FIG. 1. The generator 100 includes a receptacle 102 for receiving flowing foam solution 104 being a mixture of surfactant (or foam concentrate) and water, and an air supply 106 for supplying pressurized air 108 into the foam solution 104 to create foam 110. The generator 100 further includes turbulence creators 112, 114 for creating turbulence in the receptacle 102 to assist with mixing the air 108 and foam solution 104 when forming the foam 110.

Advantageously, the generator 100 provides for improved mixing and evenness of foam 110, without foam flooding, when compared with known foam generators. The generator 100 is also simple to manufacture when compared with known foam generators and is described in detail below.

The turbulence creators 112, 114 are located downstream and upstream of a region 116 where air is introduced into the foam solution 104. The downstream turbulence creator 112 is in the form of a diffuser 118 for diffusing the air 108 in the foam solution 104. The diffuser includes a triplet of alternating baffles 120. Each baffle snugly fits within and occupies about half of the cross section of the receptacle 102, and defines edge teeth 122 to encourage diffusion.

The upstream turbulence creator 114 includes an impermeable portion 124 of an air supply tube 126 that impacts with the foam solution 104 and is located upstream from air outlets 128. The tube 126 of the air supply 106 extends into the receptacle 102 and transverse to flow of the foam solution 104. In this manner, the tube 126 is arranged so that the water splits around either side of the tube 126 causing turbulence.

The receptacle 102 is elongate and tapers at both ends. Further, the stainless steel receptacle 102 includes a central cylindrical pipe 129 terminated by a pair of conical reducers 130. Each end of the receptacle 102 is threaded to facilitate connection to threaded hose fasteners.

The air supply tube 126 includes internal air outlets 128 located downstream from the impermeable portion 124. The outlets 128 include five evenly spaced rows of perforations. Each row of perforations is staggered relative to any adjacent row to facilitate even foam creation. The outlets 128 are spread out to entirely span the downstream half of the tube 126.

The method for generating the firefighting foam 100 with the generator 100 is simple and effective, involving simply introducing the air 108 in the foam solution 104 and creating turbulence to produce superior foam 110.

A person skilled in the art will appreciate that many embodiments and variations can be made without departing from the ambit of the firefighting foam generators described herein and methods for using the same.

Figure 2:
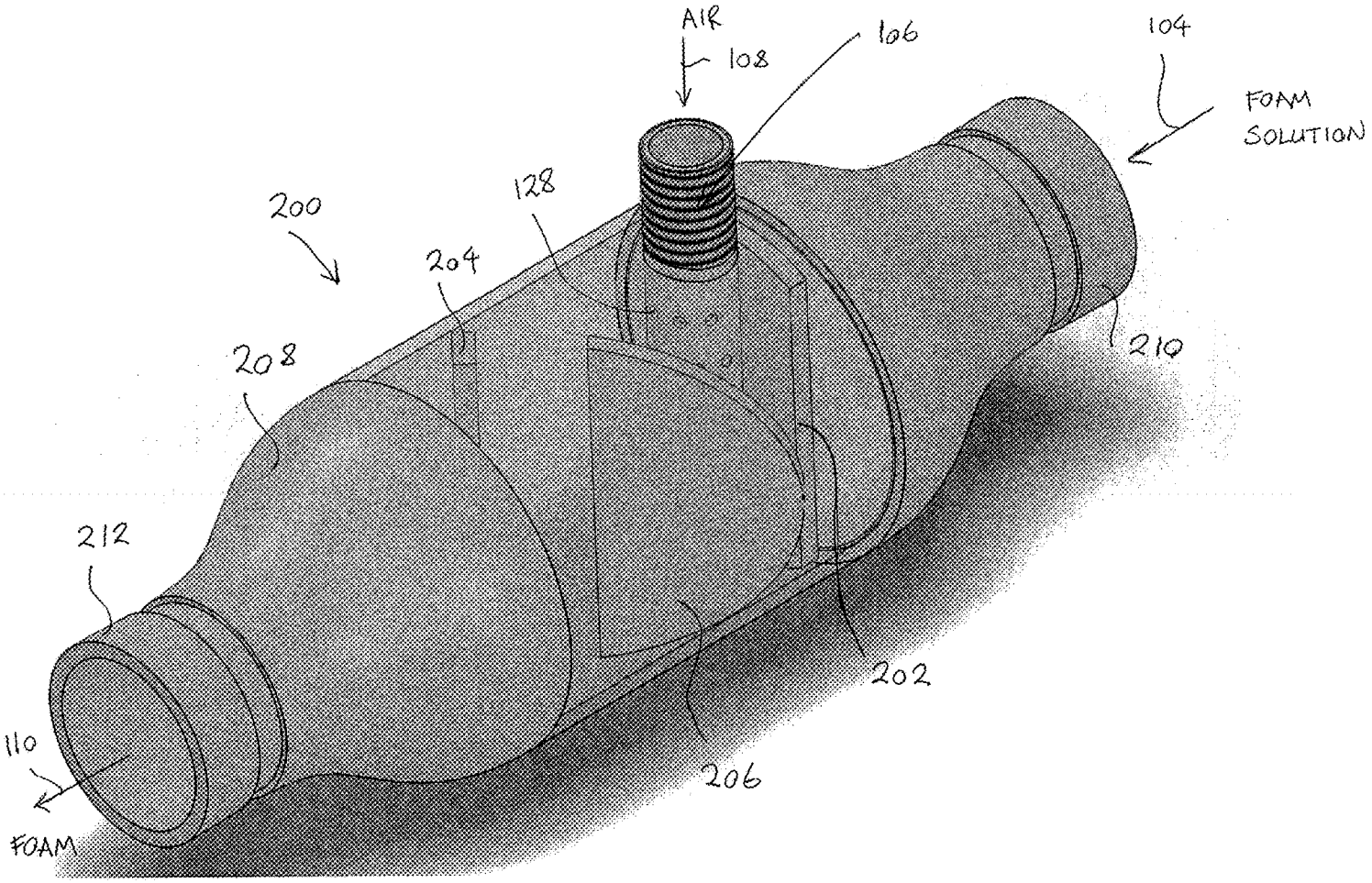
FIG. 2 is a perspective view of a firefighting foam generator in accordance with another embodiment of the firefighting foam generator.

Another generator 200 in accordance with a further embodiment is shown in FIG. 2. The generator 200 includes an additional turbulence creator in the form of a transverse baffle 202 located upstream of the air supply 106. The downstream diffuser includes a pair of opposed and oblique baffles 204, 206. The air supply 106 can define a threaded hose connector, and the ends of the receptacle 208 may include a pair of flanged end connectors 210, 212.

Figure 3:
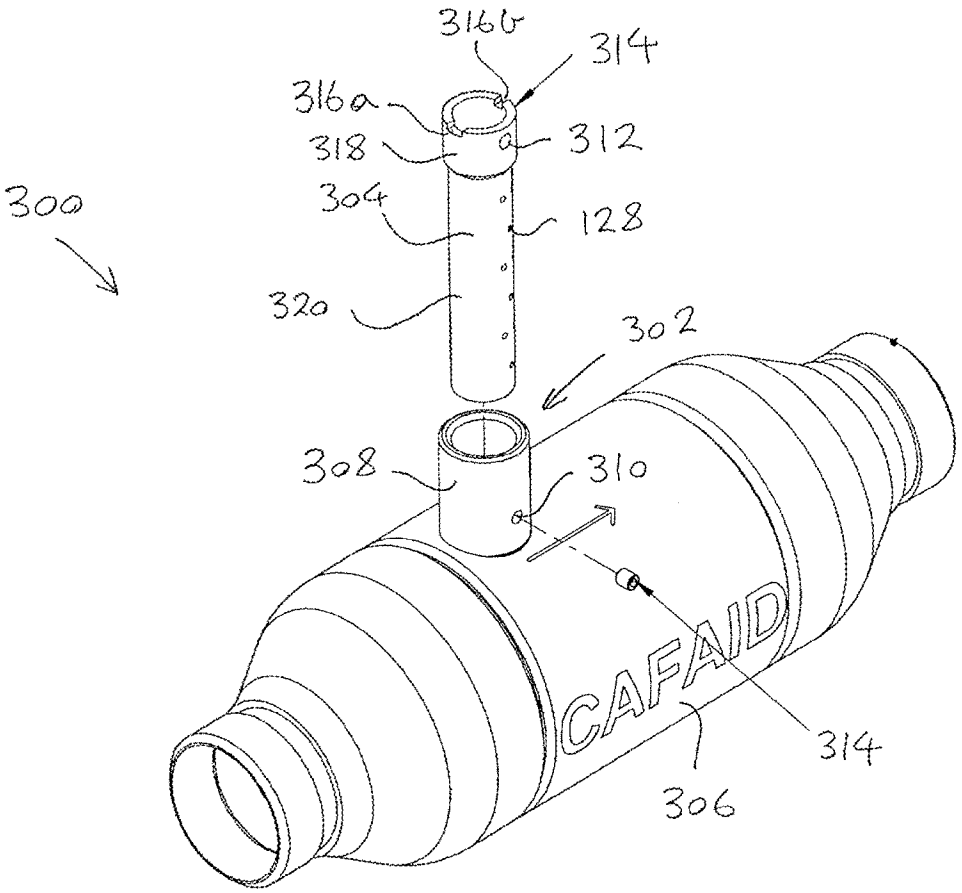
FIG. 3 is a perspective view of a firefighting foam generator in accordance with another embodiment of the firefighting foam generator.

Another generator 300 in accordance with a further embodiment is shown in shown in FIG. 3. The generator 300 includes a retainer 302 for retaining the air supply tube 304 within the receptacle 306. The retainer 302 includes a tubular guide 308 extending from the receptacle 306. The guide 308 defines a fastening hole 310 which can align with a fastening hole 312 of the tube 304. The retainer 302 further includes a grub screw 314 for passing through the holes 310, 312 to retain the tube 304 within the receptacle 306.

The tube 304 is releasable, and can be readily replaced with another tube having a different arrangement of air outlets 128 to alter the characteristics of the foam. The tube 304 includes a top orientation indicator 314 to indicate the orientation of the tube 304 in the receptacle 306 when looking down into the guide 308. The orientation indicator 314 is located at the outside end of the tube 304 to facilitate viewing. The orientation indicator 314 includes two notches 316*a*, 316*b* of different sizes with the smaller notch 316*b* being aligned with the air outlets 128. In use, the tube 304 can be turned, by inserting a tool into the notches 316, within the guide 308 to the correct orientation so that the fastening holes 310, 312 are aligned and the air outlets 128 are facing downstream.

The tube 304 defines an enlarged head 318 for resting on the receptacle 306 when a narrower elongate tail 320, extending from the head 318 and defining the air outlets 128, extends into the receptacle 306.

In one embodiment, the downstream diffuser 118 may not be required. In particular, a narrower diameter of pipe 129 (say ¾ inch (1.9 cm)) with only the initial diffuser and air supply tube 126 will provide sufficient scrubbing and turbulence to produce good quality finished foam 110.

A skilled person will appreciate that that the air volume can be tuned on each foam generator 100 to provide the most effective finished foam 110. Although using 60 cfm (1.7 cmm) at 10 bar (1000 kPa) per generator 100 yields excellent results, the volume can be tuned given the nature of the generator 100 by reducing volume using a restriction to the generator 100.

The embodiments have been described in language more or less specific to structural or methodical features. It is to be understood that the embodiments are not limited to specific features shown or described since the means herein described comprises preferred forms of putting the firefighting foam generator into effect.

Reference throughout this specification to 'one embodiment' or 'an embodiment' means that a particular feature, structure, or characteristic described in connection with the embodiment is included in at least one embodiment described herein. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

What is claimed is:

1. A firefighting foam generator including:

a receptacle for receiving a flow of liquid;

a gas supply for supplying pressurized gas into the flow of liquid to create foam, the gas supply comprising a tube which extends into the receptacle transverse to the flow of liquid, the tube includes a plurality of gas outlets, and a first and second turbulence creator, each for creating turbulence in the receptacle, the first turbulence creator including a baffle positioned within the receptacle at a first location spaced apart from and upstream of the tube, relative to the flow of liquid, and the second turbulence creator including a baffle positioned within the receptacle at a second location downstream of the tube, relative to the flow of liquid, each turbulence creator comprising an edge, positioned transverse to the flow of liquid which extends between and contacts the receptacle at a first position and a second position.

2. A firefighting foam generator as claimed in claim 1, wherein the tube includes an impermeable portion that impacts with the liquid and is located upstream from the gas outlets.

3. A firefighting foam generator as claimed in claim 1, wherein the first turbulence creator includes a plurality of baffles upstream of the gas supply.

4. A firefighting foam generator as claimed in claim 1, wherein at least one the turbulence creators includes a diffuser for diffusing the gas in the liquid.

5. A firefighting foam generator as claimed in claim 4, wherein the diffuser is located downstream of the gas supply.

6. A firefighting foam generator as claimed in claim 4, wherein the diffuser includes one or more baffles.

7. A firefighting foam generator as claimed in claim 6, wherein the one or more baffles are alternating.

8. A firefighting foam generator as claimed in claim 6, wherein each baffle occupies about half of a cross section of the receptacle.

9. A firefighting foam generator as claimed in claim 6, wherein each baffle defines teeth.

10. A firefighting foam generator as claimed in claim 1, wherein the tube is arranged so that the liquid splits around either side of the tube, the plurality of gas outlets forming rows of staggered perforations.

11. A firefighting foam generator as claimed in claim 10, wherein the gas outlets are located on a downstream half of the tube.

12. A firefighting foam generator as claimed in claim 1, wherein the tube is releasable and includes an orientation indicator to indicate an orientation of the tube in the receptacle.

13. A firefighting foam generator as claimed in claim 1, wherein the tube defines a head for resting on the receptacle when a tail extending from the head extends into the receptacle.

14. A firefighting foam generator as claimed in claim 1, wherein the firefighting foam generator includes a retainer for retaining the tube within the receptacle, the retainer including a tubular guide extending from the receptacle.

15. A firefighting foam generator as claimed in claim 14, wherein the tubular guide defines a fastening hole which can align with a fastening hole of the tube, the retainer further including a fastener for passing through the fastening holes to retain the tube within the receptacle.

16. A firefighting foam generator as claimed in claim 1, wherein the receptacle is elongate and tapers at one or both ends.

17. A firefighting foam generator as claimed in claim 1, wherein the gas supply supplies the pressurized gas at 10 bar (1000 kPa).

* * * * *